United States Patent [19]

Kasai

[11] Patent Number: 4,577,377

[45] Date of Patent: Mar. 25, 1986

[54] BUCKLE FOR STRAPS

[75] Inventor: Kazumi Kasai, Namerikawa, Japan

[73] Assignee: Nippon Notion Kogyo Co., Ltd., Tokyo, Japan

[21] Appl. No.: 609,426

[22] Filed: May 11, 1984

[30] Foreign Application Priority Data

May 13, 1983 [JP] Japan ..... 58-71465[U]

[51] Int. Cl.[4] ..... A44B 11/25

[52] U.S. Cl. ..... 24/625; 24/633

[58] Field of Search ..... 24/614–616, 24/618, 625, 633, 662, 664, 665, 636

[56] References Cited

U.S. PATENT DOCUMENTS

| | | | |
|---|---|---|---|
| 618,895 | 2/1899 | Munday | 24/615 X |
| 780,192 | 1/1905 | Jones | 24/615 X |
| 1,450,199 | 4/1923 | Barber | 24/665 X |
| 3,179,969 | 4/1965 | Glynn | 24/625 X |
| 3,430,306 | 3/1969 | Toreau | 24/625 X |
| 3,979,934 | 9/1976 | Isenmann | 24/615 X |
| 4,035,877 | 7/1977 | Brownson et al. | 24/633 X |
| 4,150,464 | 4/1979 | Tracy | 24/615 X |
| 4,246,680 | 1/1981 | Gray | 24/616 X |
| 4,268,101 | 5/1981 | Stone | 24/664 X |
| 4,425,689 | 1/1984 | Fildan | 24/664 |

FOREIGN PATENT DOCUMENTS

| | | | |
|---|---|---|---|
| 95656 | 12/1983 | European Pat. Off. | 24/615 |
| 2812069 | 10/1979 | Fed. Rep. of Germany | 24/665 |
| 2451175 | 11/1980 | France | 24/616 |
| 55-55217 | 12/1980 | Japan . | |

*Primary Examiner*—William E. Lyddane
*Assistant Examiner*—James R. Brittain
*Attorney, Agent, or Firm*—Hill, Van Santen, Steadman & Simpson

[57] ABSTRACT

A buckle comprises a male member including a pair of resiliently flexible legs each having an abutment surface, and a female member having a socket portion releasably couplable with said legs and including a pair of spaced sidewalls defining therebetween a slot for receiving therein said legs, each of the sidewalls having a retaining surface engageable with the abutment surface to interlock the male and female members. The socket portion further has a pair of cantilevered arms disposed inwardly of the sidewalls and resiliently flexible toward and away from the sidewalls. An actuating lug is disposed on a distal end of each arm which is located outside of the slot, the lug being engageable with one of the legs. The arms are resiliently flexible toward each other to cause the actuating lugs to urge the legs to flex resiliently toward each other for bringing the abutment surface and the retaining surface out of engagement with one another. As movement of the arms away from each other is limited by the sidewalls, the arms are protected from being damaged or broken when subjected to undue lateral pulling forces tending to spread the arms.

11 Claims, 14 Drawing Figures

BUCKLE FOR STRAPS

BACKGROUND OF THE INVENTION

1. Field of the Invention

The present invention relates to a buckle for releasably connecting loose ends of a belt or strap applied to garments, bags and the like.

2. Prior Art

A buckle disposed in Japanese Utility Model Publication No. 55-55217 published on Dec. 20, 1980 comprises a male member having a pair of parallel cantilevered resilient legs, and a female member having a pair of opposed sidewalls defining therebetween a slot into which the legs are frictionally inserted until feet on the respective legs are snapped into engagement with locking edges of the sidewalls to thereby lock the male and female members in coupled condition. To release both members from one another, a pair of cantilevered resilient grip arms is disposed on the female member outwardly of the sidewalls, respectively, with their free ends directed toward the feet of the legs. When the grip arms are pressed by fingers, the free ends of the arms are brought into engagement with the feet and then urge the latter out of engagement with the locking edges against the resiliency of the legs, to thereby allow the male member to be detached from the female member. A disadvantage of the disclosed buckle is that the grip arms are likely to be damaged or broken when subjected to lateral pulling forces tending to spread the arms.

SUMMARY OF THE INVENTION

It is, therefore, an object of the present invention to provide a buckle in which grip arms of a female member are protected from damage or breakage when subjected to lateral pulling forces tending to spread the arms.

According to the present invention, a buckle comprises a male member including a pair of resiliently flexible legs each having an abutment surface, and a female member having a socket portion releasably couplable with the legs and including a pair of spaced sidewalls defining therebetween a slot for receiving therein said legs, each of the sidewalls having a retaining surface engageable with said abutment surface to interlock the male and female members. The socket portion further has a pair of cantilevered arms disposed inwardly of the sidewalls and which are resiliently flexible toward and away from the sidewalls. Each of the arms has a distal end disposed outside of the slot and an actuating lug disposed on the distal end and engageable with one of the legs. The arms are resiliently flexible toward each other to cause the actuating lugs to urge the legs to flex resiliently toward each other for bringing the abutment surface and the retaining surface out of engagement with one another. With this arrangement, movement of the arms away from each other is limited by the sidewalls so that the arms are protected from being damaged or broken when subjected to undue lateral pulling forces tending to spread the arms.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 12:
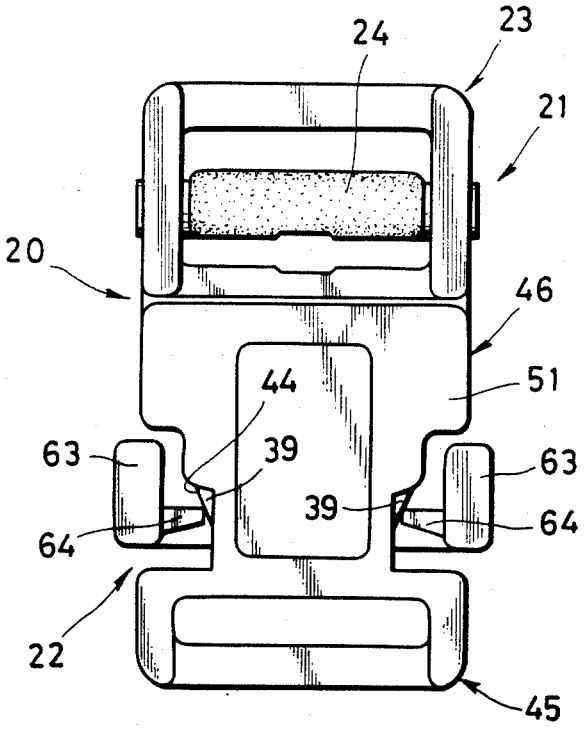
FIG. 12 is a plan view of the male and female members of the buckle shown engaged or connected.

The principles of the present invention are particularly useful when embodied in a buckle as shown in FIG. 12, generally indicated by the numeral 20. The buckle 20 comprises a male or plug member 21 and a female or socket member 22 releasably coupled with the male member 21.

Figure 1:
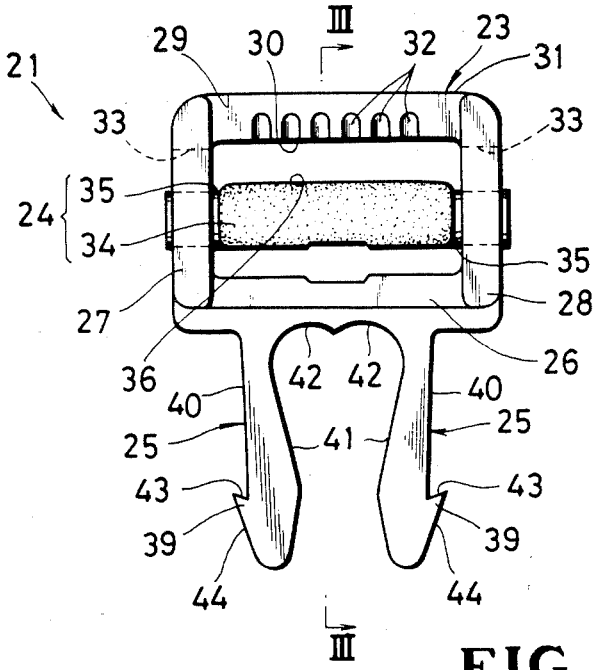
FIG. 1 is a bottom view of a male or plug member which constitutes one part of a buckle embodying the present invention.

As better shown in FIG. 1, the male member 21 includes a hollow connector frame 23 of a rectangular shape, a strap retainer 24 movably mounted on the hollow connector frame 23, and a pair of resiliently flexible legs 25, 25 integrally formed with the hollow connector frame 23. The connector frame 23, the strap retainer 24 and the legs 25, 25 are all molded of synthetic resin.

The hollow connector frame 23 comprises a base 26, a pair of spaced parallel stems 27, 28 extending transversely from opposite ends of the base 26, and a connecting bar 29 transversely joining the stems 27, 28 at distal ends thereof remote from the base 26. The connecting bar 29 has a flat strap bearing surface 30 facing toward the base 26, and a bottom surface 31 (FIG. 3) extending perpendicularly from the strap bearing surface 30 and having therein a plurality of parallel grooves 32, the grooves 32 extending from the strap bearing surface 30 parallel to the arms 27, 28 away from the base 26. The bottom surface 31 thus constructed serves as a strap supporting surface. The stems 27, 28 have a pair of oblong slots 33, 33 extending longitudinally of the stems 27, 28 in transverse registry with each other, the slots 33, 33 having ends spaced a distance from the strap bearing surface 30 to provide a sufficient mechanical strength at the joints of the connecting bar 29 and the arms 27, 28. Each of the stems 27, 28 has a width greater than the widths of the base 26 and the connecting bar 29, as shown in FIG. 3.

Figure 2:
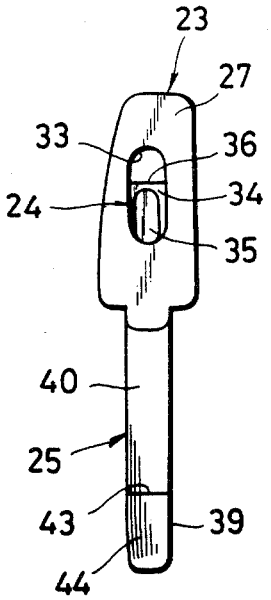
FIG. 2 is a left side elevational view of FIG. 1.

The strap retainer 24 is composed of a central strap engagement portion 34 and a pair of coaxial arms 35, 35 integrally formed with the strap engagement portion 34 at opposite ends thereof. The arms 35, 35 have an oval cross section as shown in FIG. 2, and are loosely received in the oblong slots 33, 33, respectively, for sliding movement therein, but are prevented from rotating in the respective slots 33, 33. The central strap engagement portion 34 includes a flat strap pressing surface 36 extending in confronting relation to the strap bearing surface 30. In the illustrated embodiment, the strap engagement portion 34 has a roughened surface similar to a grain finish, having a multiplicity of minute projections to give an increased coefficient of friction to the strap engagement portion 34. The arms 35 are slightly displaced out of coaxial alignment with the central strap engagement portion 34 toward the base 26.

Figure 3:
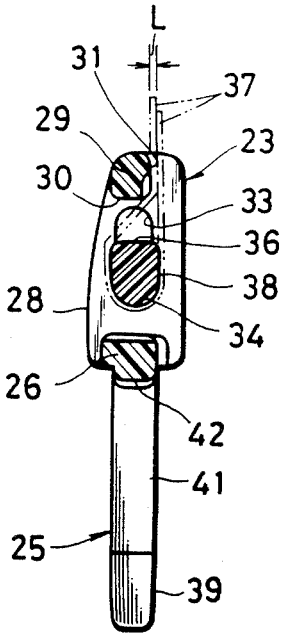
FIG. 3 is a cross-sectional view taken along line III—III of FIG. 1.
Figure 4:
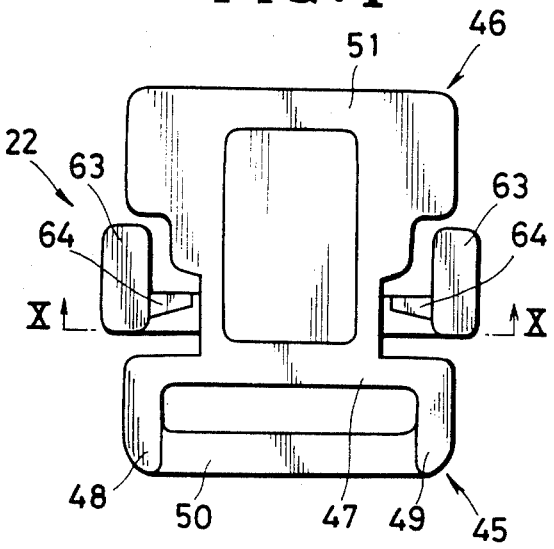
FIG. 4 is a plan view of a female or socket member which constitutes the other part of the buckle.
Figure 6:
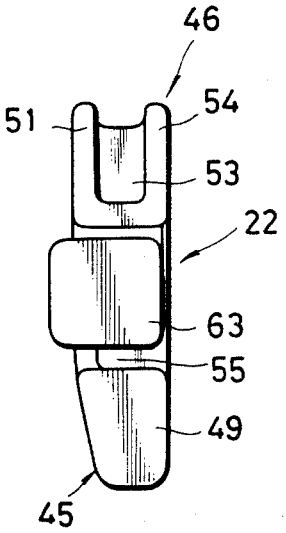
FIG. 6 is a side elevational view of FIG. 4.
Figure 5:
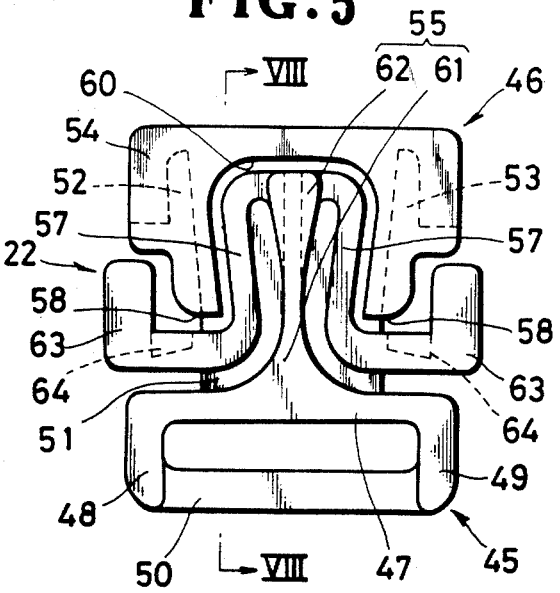
FIG. 5 is a bottom view of the female member.
Figure 7:
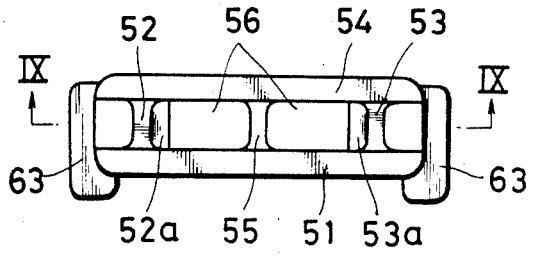
FIG. 7 is an end elevational view of FIG. 5.
Figure 8:
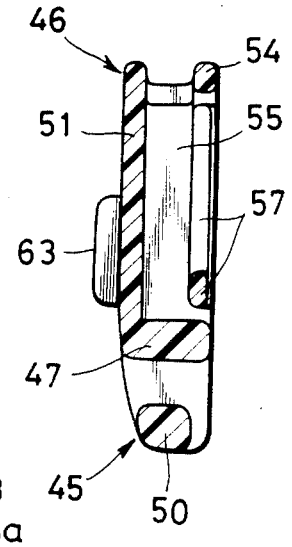
FIG. 8 is a cross-sectional view taken along line VIII—VIII of FIG. 5.
Figure 13:
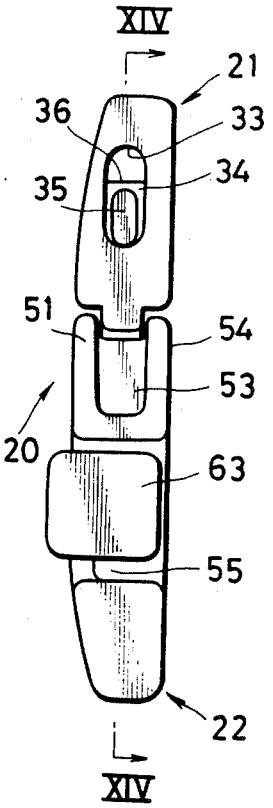
FIG. 13 is a side elevational view of FIG. 12.

In use, a strap end portion 37 is frictionally held against the strap supporting surface 31 on the connecting bar 29 while forming a loop around the strap retainer 24, as shown in FIG. 3. When the strap end portion 37 thus attached is tensioned longitudinally, the strap retainer 24 is displaced toward the connecting bar 29 to enable the strap pressing surface 36 to press the strap end portion 37 against the strap bearing surface 30. The strap end portion 37 is thus prevented from being loosened off the connector frame 23 and hence the male member 21. As shown in FIG. 3, the strap guide surface 31 is offset from a bottom surface 38 of the strap engagement portion 34 by a distance L which corresponds to the thickness of the strap end portion 37; if it were not so, when the strap end portion 37 is tensioned longitudinally, the male member 21 as coupled with the female member 22 as shown in Fig. 13 would be displaced leftward of this figure away from an article (not shown) on which the buckle 20 is used. Although not shown, such strap guide surface 38 may be provided on the face side of the connecting bar 29 in which case the strap guide surface is offset from a top surface of the strap engagement portion 34.

As shown in FIG. 1, the legs 25, 25 extend from the base 26 away from the connecting bar 29 and have a pair of locking projections 39, 39 projecting from distal ends thereof laterally away from one other. Each of the legs 25 has an outer side surface 40 extending between the base 26 and the locking projection 39 in perpendicular relation to the base 26, and an inner side surface 41 extending from the base 26 toward the distal end in inclined relation to the base 26 such that the leg 25 gradually increases in width in a direction from the base 26 toward the distal end thereof. The inner surface 41 is blended into an arcuate side surface portion 42 of the base 26. The legs 25, 25 thus constructed have an increased degree of resilient flexibility in a direction toward each other than in a direction away from one another. The locking projections 39, 39 have a pair of abutment surfaces 43, 43, respectively, facing toward the base 26, and a pair of sliding surfaces 44, 44 extending respectively from the abutment surfaces 43, 43 convergently toward the distal ends of the respective legs 25, 25. The abutment surfaces 43, 43 are slightly inclined toward the outer surfaces 40, 40 of the respective legs 25, 25.

The female member 22 is, as shown in FIGS. 4 to 7, includes a hollow connector frame 45 of a rectangular shape, and a socket portion 46 integrally formed with the hollow connector frame 45 for receiving therein the legs 25 of the male member 21 (FIG. 1). The connector frame 45 and the socket portion 46 are molded of synthetic resin.

The hollow connector frame 45 comprises a base 47, a pair of spaced parallel stems 48, 49 extending from opposite ends of the base 47, and a connecting bar 50 joining the ends of the stems 48, 49 which are remote from the base 47. Another strap end portion (not shown) is attached to the connector frame 45 with a loop extending around the connecting bar 50. The connector frame 45 may have the same structure as the connector frame 23 of the male member 21.

The socket portion 46 includes a generally T-shaped top plate 51 extending from the base 47 away from the connecting bar 50, a pair of spaced sidewalls 52, 53 projecting from the underside of the top plate 51, a bottom plate 54 of an inverted U-shape transversely joining the sidewalls 52, 53, and a central partition wall 55 projecting from the underside of the top plate 51 between the sidewalls 52, 53, the partition wall 55 being joined at one end thereof with the base 47 of the connector frame 45. The plates 51, 54 and the walls 52, 53, 55 jointly define therebetween a pair of slots 56, 56 (FIGS. 7 and 10) for receiving respectively therein the legs 25 of the male member 21. The socket portion 46 further has a pair of generally Z-shaped resilient arms 57, 57 cantilevered on the other end of the partition wall 55, the arms 57, 57 having respective distal ends disposed outside of the slots 56, 56.

The sidewalls 52, 53 extend from an upper end of the top plate 51 toward the base 47 and have a pair of opposed inner guide surfaces 52*a*, 53*a* converging toward the base 47 at an angle which is different from the angle of divergency of the sloping surfaces 44, 44 (FIG. 1). Each of the sidewalls 52, 53 further has a retaining surface 58 blending into a corresponding one of the inner surfaces 52*a*, 53*a* and facing toward the base 47 with a space 59 (FIG. 9) therebetween. The bottom plate 54 underlies a head portion of the T-shaped top plate 51 and has means defining a U-shaped recess 60 (FIGS. 5 and 9) facing toward the central partition wall 55. The one end of the central partition walls 55 flares toward the base 47 as at 61, and the opposite end of the wall 44 has a triangular base 62 tapering toward the flaring one end, the arms 57 extending from the triangular base 62.

Figure 9:
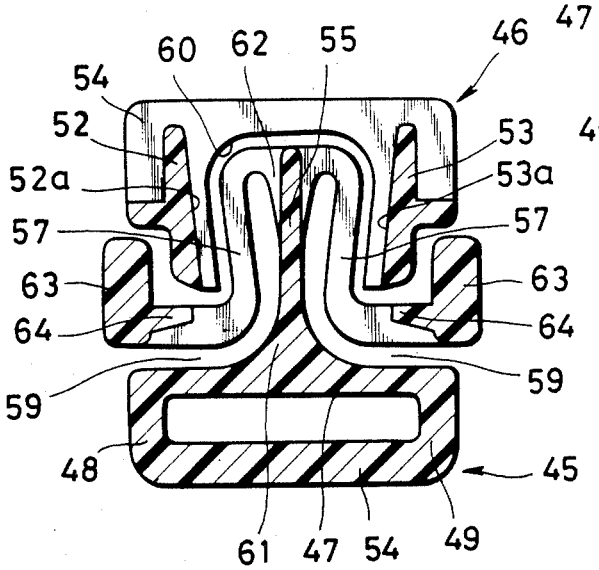
FIG. 9 is a cross-sectional view taken along line IX—IX of FIG. 7.
Figure 10:
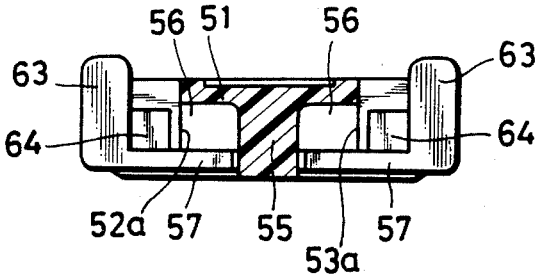
FIG. 10 is a cross-sectional view taken along line X—X of FIG. 4.
Figure 11:
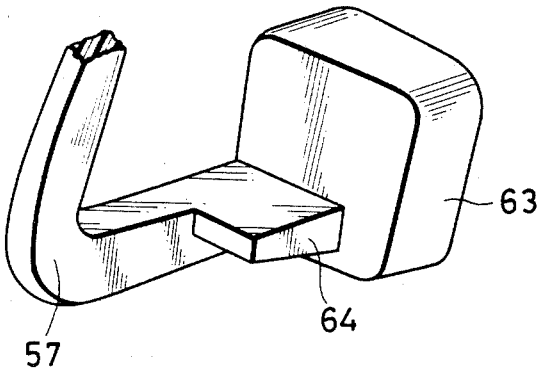
FIG. 11 is an enlarged perspective view of a portion of the female member.

As better shown in FIGS. 9 and 10, the resilient arms 57, 57 are joined at their one end to the triangular base 62 of the partition wall 55 and have a thickness slightly thinner than the thickness of the bottom plate 54. The arms 57, 57 are disposed such that they extend first from the triangular base 62 laterally outwardly in opposite directions toward the respective sidewalls 52, 53, then between the central partition wall 55 and the sidewalls 52, 53 toward the base 47, and finally laterally outwardly in opposite directions across the respective spaces 59. The arms 57, 57 extend in substantially the same plane as the bottom plate 54 along the U-shaped recess 60 with a space therebetween.

Each of the resilient arms 57, 57 has an integral enlarged hand grip 63 disposed on the distal end thereof and projecting perpendicularly away from the bottom plate 54 beyond the top plate 51. The arm 57 further has an actuating lug 64 extending from the hand grip 63 toward the central partition wall 55 and terminating short of the slot 56, as shown in FIG. 10.

Figure 14:
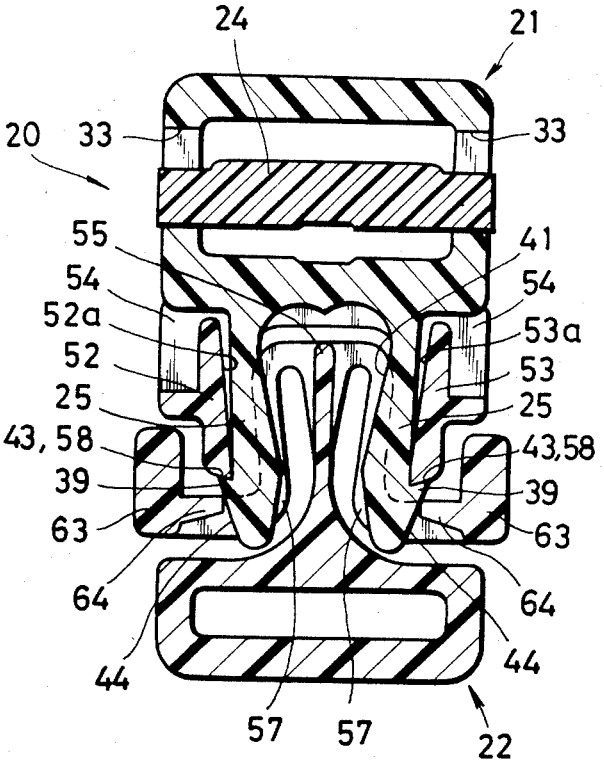
FIG. 14 is a cross-sectional view taken along line XIV—XIV of FIG. 13.

To couple the male and female members 21, 22 of the buckle 20 as shown in FIGS. 12 to 14, the resilient legs 25, 25 of the male member 21 are inserted into the socket member 21 to the female member 22. In this instance, the inner guide surfaces 52*a*, 53*a* of the sidewalls 52, 53 are brought into frictional engagement with the sliding surfaces 44 of the locking projections 39, whereupon the legs 25 are urged to flex resiliently toward each other. Further advancing of the legs 25 causes the locking projections 39 to move past the respective inner surfaces 52*a*, 53*a*, thus enabling the legs 25 to expand to their original position illustrated in FIG. 14. In this position, the abutment surfaces 43 of the locking projections 39 ae brought into engagement with the retaining surfaces 58 of the sidewalls 52, 53, thereby locking the male and female members 21, 22 in coupled condition. The actuating lugs 64 are held in contact with the guide surfaces 44 so that they do not apply to the legs 25 any forces tending to cause disengagement of the projections 39 and the sidewalls 52, 53. When the surfaces 43, 58 abut together, they generate a pleasant sound of engagement, thus enabling a user to cease further advancing of the legs 25 in the socket portion 46.

To disengage the male and female members 21, 22, the hands grip 63 are pressed by a user's fingers to resiliently flex the arms 57 toward each other, whereupon the actuating lugs 64 urge the projections 39 toward each other against the resiliency of the legs 25. Further pressing on the hands grip 63 causes the abutment surfaces 43 to disengage from the retaining surfaces 58, thus allowing the male member 21 to be detached from the female member 22. In this instance, since the sliding surfaces 44 and the guide surfaces 52*a*, 53*a* diverge in the same direction but at different angles, the legs 25 are thrusted out from the socket portion 46 of the female member 22 by the resilient forces stored therein.

The buckle 20 of the foregoing construction has many advantages: With the resilient arms 57 being disposed inwardly of the sidewalls 52, 53, when the arms 57 are subjected to lateral pulling forces, movement of the arms 57 away from one another is prevented by the U-shaped recess 60 of the bottom plate 54 which extends in substantially the same plane as the arms 57. The bottom plate 54 may be omitted in which case the sidewalls 52, 53 and the partition wall 55 are constructed to have the same height so that the sidewalls 52, 53 engage the arms 57 to prevent further spreading movement of the latter. Movement of the arms 57 toward each other is limited by the central partition wall 55 disposed between the arms 57. As the guide surfaces 52*a*, 53*a* and the sliding surfaces 44 diverge in the same direction but at different angles, the legs 25 are automatically expelled from the socket portion 46 of the female member 22 by their own resiliency. With the strap guide surface 31 being offset from the bottom surface 38 of the engagement portion 34 by a distance L substantially equal to the thickness of the strap end portion, the male member 21 as coupled with the female member 22 is prevented from being displaced away from an article on which the buckle is used, when the strap end portion attached to the connector frame 23 is tensioned longitudinally with a loop around the engagement portion 34.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A buckle for fastening strap end portions comprising:

(a) a male member including a first connector frame connectable to one of the strap end portions, and a pair of resiliently flexible legs extending from said first connector frame in a common direction, each said leg having an abutment surface having toward said first connector frame; and (b) a female member having a second connector frame connectable to the other strap end portion, and a socket portion joined with said second connector frame and releasably couplable with said legs, said socket portion including (1) a plate extending from said second connector frame and a pair of spaced sidewalls disposed on one surface of said plate and extending longitudinally of said plate so as to define therebetween a slot for receiving therein said legs, each of said sidewalls having a retaining surface facing toward said second connector frame and respectively engageable with said abutment surfaces of said legs to interlock said male and female members, (2) a pair of cantilevered arms disposed inwardly of said sidewalls and resiliently flexible toward and away from said sidewalls, each said arm having a distal end disposed outside of said slot and an actuating lug disposed on said distal end and engageable with one of said legs, said arms being resiliently flexible toward each other to cause said actuating lugs to urge said legs to flex resiliently toward each other for bringing said abutment surface and said retaining surface out of engagement with one another, and (3) a central partition wall disposed on said surface of said plate and spaced equidistantly from said sidewalls to separate said slot into two slot portions for receiving therein said legs, respectively, said arms being connected to said partition wall, one on each side of said partition wall.

2. A buckle according to claim 1, said legs having a pair of locking projections respectively projecting from distal ends thereof laterally away from one another, said projections having said abutment surfaces and a pair of sliding surfaces diverging toward said first connector frame at a first angle, said sidewalls having a pair of opposed inner guide surfaces engageable with said sliding surfaces and diverging away from said second connector frame at a second angle different from said first angle.

3. A buckle according to claim 1, said partition wall having one end joined with said second connector frame.

4. A buckle according to claim 3, said partition wall having an opposite end with which said arms at a connection.

5. A buckle according to claim 1, said male and female members comprising synthetic resin.

6. A buckle according to claim 1, including a pair of enlarged hand grips respectively disposed on said distal ends of each of said arms adjacent to said actuating lug.

7. A buckle for fastening strap end portions, comprising:

(a) a male member including a first connector frame connectable to one of the strap end portions, and a pair of resiliently flexible legs extending from said first connector frame in a common direction, each said leg having an abutment surface facing toward said first connector frame; and (b) a female member having a second connector frame connectable to the other strap end portion, and a socket portion joined with said second connector frame and releasably couplable with said legs, said socket portion including (1) a plate extending from said second connector frame and a pair of spaced sidewalls disposed on one surface of said plate and extending longitudinally of said plate so as to define therebetween a slot for receiving therein said legs, each of said sidewalls having a retaining surface facing toward said second connector frame and respectively engageable with said abutment surfaces of said legs to interlock said male and female members, (2) a pair of cantilevered arms disposed inwardly of said sidewalls and resiliently flexible toward and away from said sidewalls, each said arm having a distal end disposed outside of said slot and an actuating lug disposed on said distal end and engageable with one of said legs, said arms being resiliently flexible toward each other to cause said actuating lugs to urge said legs to flex resiliently toward each other for bringing said abutment surface and said retaining surface out of engagement with one another, (3) another plate interconnecting said sidewalls remote from the first-mentioned plate, and (4) a central partition wall disposed on said surface of the first-mentioned plate and spaced equidistantly from said sidewalls to separate said slot into two slot portions for receiving therein said legs, respectively, said arms being connected to said partition wall, one on each side of said partition wall.

8. A buckle according to claim 7, said other plate partly closing said slot.

9. A buckle according to claim 7, said arms extending in substantially the same plane as said other plate.

10. A buckle according to claim 9, said arms having a thickness slightly smaller than the thickness of said other plate.

11. A buckle according to claim 9, said other plate having means defining a recess extending outwardly along said arms and engageable with the same when said arms are spread away from each other.

* * * * *